United States Patent [19]

Williams

[11] Patent Number: 4,592,309

[45] Date of Patent: Jun. 3, 1986

[54] INTERNAL COMBUSTION ENGINE

[76] Inventor: Gerald J. Williams, R. R. #2, Nolalu, Ontario, Canada, P0T 2K0

[21] Appl. No.: 655,233

[22] Filed: Sep. 28, 1984

Related U.S. Application Data

[63] Continuation-in-part of Ser. No. 268,019, May 28, 1981, Pat. No. 4,493,296.

[51] Int. Cl.[4] ..... F02B 75/00; F02B 75/26

[52] U.S. Cl. ..... 123/39; 123/58 AA; 123/68

[58] Field of Search ..... 123/50 R, 55 R, 55 A, 123/55 AA, 39, 68, 56 C, 48 R, 48 AA

[56] References Cited

U.S. PATENT DOCUMENTS

| | | | |
|---|---|---|---|
| 2,376,479 | 5/1945 | Fehling | 123/68 |
| 2,458,672 | 1/1949 | Zoch | 123/50 R |
| 2,733,694 | 2/1956 | Brebeck | 123/48 AA |
| 3,274,982 | 9/1966 | Noguchi et al. | 123/55 AA |
| 3,604,402 | 9/1971 | Hatz | 123/56 C |
| 4,230,075 | 10/1980 | Lowther | 123/39 |
| 4,300,486 | 11/1981 | Lowther | 123/39 |
| 4,333,424 | 6/1982 | McFee | 123/39 |
| 4,381,740 | 5/1983 | Crocker | 123/55 AA |

*Primary Examiner*—Craig R. Feinberg

[57] ABSTRACT

The present invention relates to an improved internal combustion engine which separates the compression stroke from the power generator. In particular, the invention utilizes a cam profiled power shaft of a shape to accomodate the new movement of the power pistons to suit the particular phase of the combustion process.

25 Claims, 7 Drawing Figures

FIG. 1.
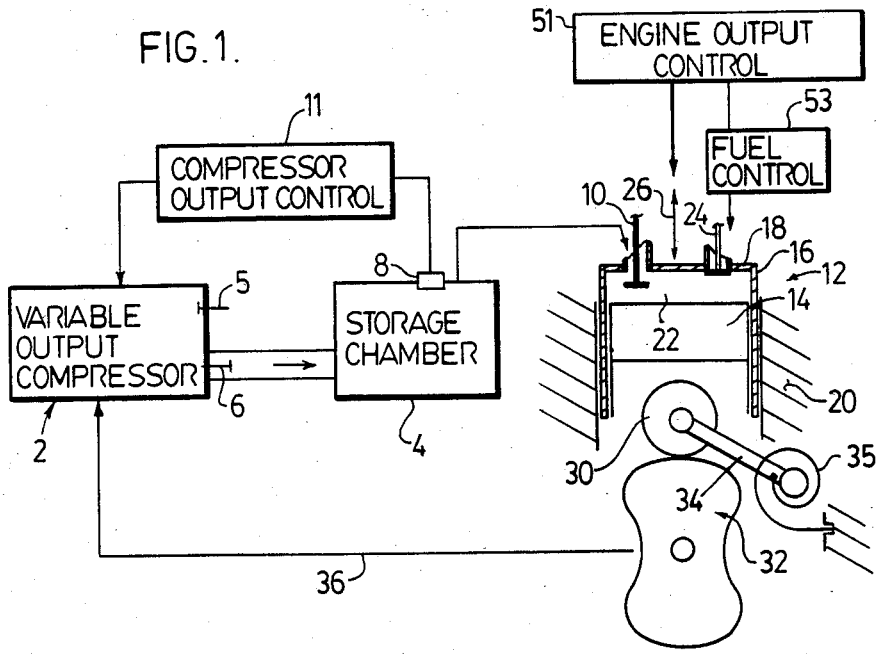
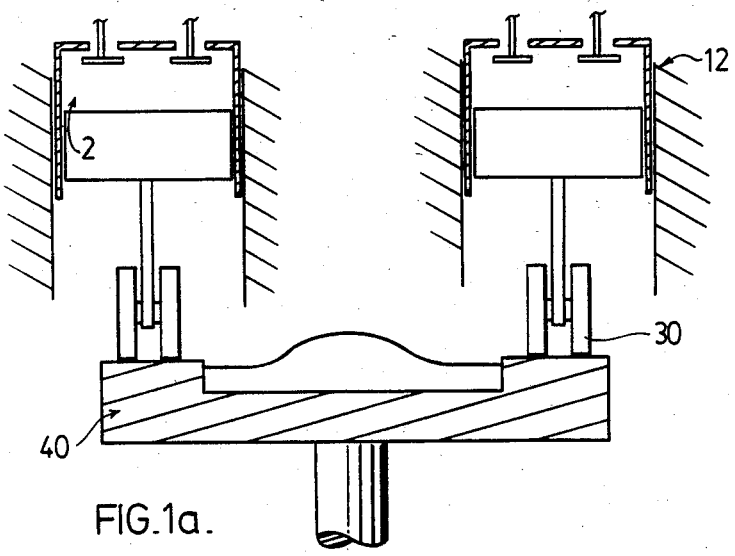
FIG. 1a.

INTERNAL COMBUSTION ENGINE

CROSS-REFERENCE TO RELATED APPLICATIONS

This is a continuation-in-part of U.S. Application, Ser. No. 268,019, filed May 28, 1981 now U.S. Pat. No. 4,493,296, and is related to U.S. Application Ser. No. 367,244, filed Apr. 12, 1982 now U.S. Pat. No. 4,510,984.

BACKGROUND OF THE INVENTION

The present invention relates to internal combustion engines of the gasoline or diesel type having reciprocating pistons and in particular relates to engines where charge compression is completed at a position remote from the power generator.

A host of different internal combustion engines have been proposed as alternatives to the standard four cycle engine. The Wankle engine departs materially from the principle of reciprocating pistons, however fails to achieve the increased efficiency presently being sought by automobile manufacturers. A number of different turbine engines have been proposed, however these too have disadvantages with respect to high cost. To a large extent recent improvements in engine efficiency have been achieved by improving the combustion process by means of different combustion chamber shapes, stratified charge, as but some examples. Increased power in smaller displacement engines has been achieved by turbo charging. Cam driven engines such as found in U.S. Pat. No. 3,274,982 Noguchi et al, variable combustion chamber volume as found in Owen U.S. Pat. No. 1,443,885 and variable compressor output engines where the compressor is physically separated from the power generator and the output of the compressor varies in accordance with engine requirements are examples of other proposed engine designs.

Cam driven engines have to date not received wide acceptance primarily due to their higher cost and difficulty in providing a simple cam profile in combination with positive piston return. Variable output compressors have been proposed, however it is difficult to match the compressor output with the engine requirements due to a lag introduced due to charge transmission, as well as a lag due to the time required for the compressor to achieve the desired output. Fixed displacement compressors in internal combustion engines have suffered as they have been sized for maximum horsepower and at reduced speeds have not been controlled in a manner to reduce the energy required to drive the compressor.

BRIEF SUMMARY OF THE INVENTION

A variable power internal combustion engine of the type having reciprocating pistons is disclosed in the present application and relies on a particular combination to achieve an engine having a variable expansion ratio of at least about 30 to 1. This combination allows for improved efficiency at power outputs other than the design power output of the engine.

The combination includes a separate air compressor for receiving and compressing a flow of air to a given pressure with the compressor having an inlet valve introducing a flow of air into the compressor, an outlet valve for exhausting the compressed air from the compressor into a compressed air storage means. At least one expander is provided having a cylinder, a cylinder head closing an end of the cylinder, a piston reciprocally mounted in the cylinder for movement away from the cylinder head in a power stroke from an initial position defining a combustion chamber within the cylinder between the cylinder head and piston to a deep expansion position for movement in an exhaust stroke towards the cylinder head and returning to the position defining the combustion chamber. An inlet valve for the combustion chamber is present for connecting the compressed air storage means thereto. The inlet valve directs the flow of compressed air into the combustion chamber during an intake phase intermediate the start of the power stroke and the completion of the exhaust stroke. An exhaust valve is provided for allowing exhaust of an expanded flow of air from the cylinder during the exhaust stroke and means for adjusting the volume of the combustion chamber is provided. The compressed air storage means receives the pressurized flow of air from the compressor and is of a volume adequate to provide compressed air in the combustion chamber essentially at the given pressure of the storage chamber essentially over the power output range of the engine. Means for introducing a combustible fuel in the compressed air charge to be present with the compressed air in the combustion chamber is provided as well as means for starting the combustion process with the inlet and exhaust valves closed. A cam shaft is provided in contact with the piston for absorbing and storing the energy of the power stroke of the piston and controlling movement of the piston within the cylinder during the exhaust stroke and the intake phase to move the piston towards the cylinder head and maintain the piston in the position defining the combustion chamber volume for time sufficient to complete the flow of compressed air into the cylinder and improved a compressed air pressure within the combustion chamber before combustion essentially equal to the pressure of the storage means. The cam also allows time for substantial combustion of the compressed air and fuel prior to the power stroke. Means for varying the volume of the combustion chamber is provided and controlled in accordance with the power requirements to provide variable power output and improved efficiency of the engine and power outputs reduced relative to the design power output of the engine by providing a variable expansion ratio of a minimum of at least about 30 to 1 at the given designed power output and higher with reduced power output. A pressure sensor is associated with the storage means for controlling the output of the compressor to reduce the work thereof when the compressed air in the storage means is essentially at the given pressure.

Such an engine recognizes the difficulties ignored in earlier designs, specifically with respect to the time required for the combustion process to be completed, as well as the time required to allow admission of the air and/or air and fuel charge. This engine structure achieves the efficiencies possible by completely separating the compression process from the power generator, however it also recognizes that one must provide sufficient time to allow the admission of the air charge and time to allow the combustion process to be essentially completed if one is to significantly improve the efficiency of the engine. It also recognizes that it is preferable to operate the engine at a generally fixed pressure over substantially the entire output range of the engine as this pressure is one of the critical parameters used in designing the capacity of the expander. It also recognizes that the variable combustion chamber volume is a more effective manner of controlling the engine output if improved efficiency over the larger power output range is to be achieved. It also recognizes that a simple control system can be used for the compressor and the compressor can be of a very simple positive fixed displacement design. Therefore, this particular combination provides a unique design having excellant efficiency over the wide power output ranges necessary for application in the automobile or vehicle field.

BRIEF DESCRIPTION OF THE DRAWINGS

Preferred embodiments of the invention are shown in the drawings wherein;

FIG. 1 is a schematic of a radial cam engine and the operation thereof according to the present invention;

FIG. 1A is a schematic similar to FIG. 1 using an axial cam shaft;

DETAILED DESCRIPTION OF THE PREFERRED EMBODIMENTS

Figure 2:
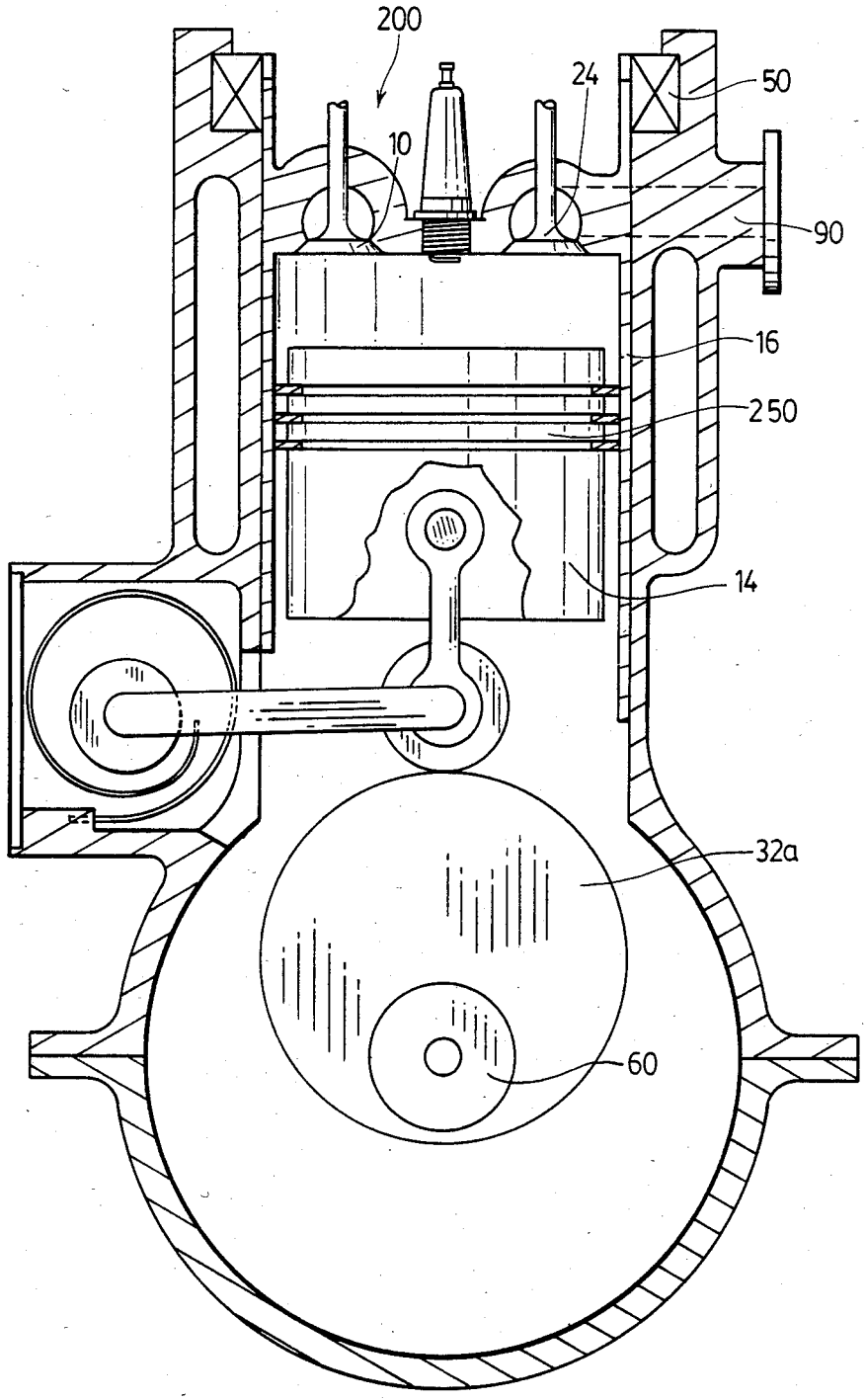
FIG. 2 is a section through the power generator using an integral cylinder head and cylinder sleeve.

The internal combustion engine as schematically illustrated in FIG. 1, includes a compressor 2 having inlet valve 5 operated in a manner to have a variable output held in a storage chamber 4 separated from the variable output compressor by a compressor outlet valve 6. A pressure sensor 8 is provided in the storage chamber for measuring the pressure of the storage chamber and controlling the compressor in a manner to reduce the work of the compressor when a desired pressure has been achieved in the storage chamber 4.

In spark ignition engines the fuel has a critical pressure and temperature point at which self ignition takes place. Therefore to obtain an expansion ratio which approaches the theoretical maximum, the air and fuel mixture should be brought close to this maximum point. This is also the starting pressure to approach the maximum with the exhaust pressure determined by other factors. This high initial pressure will improve the expansion ratio at all power outputs. Self ignition is more a function of temperature and therefore cooling of the air and/or air and fuel mixture during compression will provide a denser charge. Two stage compression with intermediate cooling can advantageously be used. In a variable geometric ratio engine, as disclosed herein, the expansion ratio increases with reduction in the initial combustion chamber volume.

In an internal combustion engine to be used with gasoline the desired pressure could be in the range of 150 to 400 psig and below the critical temperature for the given pressure. The inlet valve 5 to a piston compressor 2 can be controlled by output control 11 of pressure senser 8 to remain open when this desired pressure has been achieved. In this way, although the piston of the compressor 2 would continue to reciprocate within the compressor, it would undergo reduced work as it would not be compressing the air charge. This operation procedure is referred to as unloading of the compressor. In the case of diesel engines and or fuel injection engines, the pressure would be preferrably in excess of 500 psig.

The storage chamber 4 is connected to the inlet valve 10 of the expander 12. Expander 12 includes a piston 14, a cylinder sleeve 16 and a cylinder head 18. The cylinder sleeve 16 is moveable within the cylinder block, generally identified as 20. A combustion chamber, generally designated 22, is defined by the piston 14, the cylinder sleeve 16 and the cylinder head 18. Within the cylinder head an exhaust valve 24 is provided. In a gasoline type engine, the fuel could be mixed with the air charge prior to admission to the combustion chamber and/or could be injected directly into the combustion chamber. In a diesel application where the admission of the fuel causes the start of the combustion process, the fuel would be admitted directly to the combustion chamber 22 with the inlet and exhaust valves closed. The inlet valve 10 and the exhaust valve 24 operate in a manner similar to a conventional engine although the timing is varied somewhat due to the cam design.

The inlet and exhaust valves move with the movement of cylindrical sleeve 16 to allow for a variable combustion chamber volume. The motion of the cylindrical sleeve and the cylinder head is indicated by arrow 26 and allows control of power output. The piston 14 is connected to a cam contacting roller 30 in contact with the double lobed radial cam generally indicated as 32. A piston biasing arm 34 includes a coil spring 35 secured to said arm 34 and said cylinder block 20 to maintain the cam engaging roller 30 in contact with the cam. It is preferable that the radial cam 32 which receives the power from the piston 14 during the power stroke thereof also drives the compressor. This is generally indicated by the communication line 36. The embodiment shown in FIG. 1*a* is very similar to Figure 1, however an axial cam shaft 40 is shown operatively connected to the cam contacting roller 30. In this embodiment a tangential arm not shown maintains the position of the cam contacting roller 30 and is similarly spring biased to be in continuous contact with the cam. The compressor 2 is shown operatively driven by the axial cam.

The cyclic process of the internal combustion piston engine with variable power output of Figure 1 comprising the steps of compressing a flow of air to a given pressure to provide a compressed air charge supply, accumulating a storage of compressed air charge supply, operatively connecting the accumulated storage of compressed air with inlet valve 10 of a power expander 12 having a combustion chamber 22 and a movable piston 14 which defines part of the combustion chamber 22 when the piston 14 is essentially stationary and defining the combustion chamber volume, holding the piston 14 essentially stationary defining the combustion chamber 22 for at least about 15 degrees of a 360 degree piston cycle, closing the inlet valve of the power expander after admission of an amount of compressed air determined by the volume of the combustion chamber, admitting a combustible fuel to mix with the amount of compressed air to be at least present in the combustion chamber, igniting the compressed air and fuel in the combustion chamber causing the piston to drive against a cam shaft in a power stroke, opening an exhaust valve in a manner to allow positive expulsion of the combusted fuel and air by movement of the piston in a direction opposite to the direction of the power stroke and caused by further rotation of said cam and closing the exhaust valve after positive expulsion of the combusted fuel and air, monitoring the pressure in the storage of compressed air and varying such flow of air to be compressed to reduce energy expended in compressing such flow of air when the desired pressure of compressed air is achieved, and adjusting the volume of the combustion chamber in accordance with power output requirements of the engine wherein the process provides a variable expansion ratio of at least about 30 to 1 at a design power output of such engine and a higher expansion ratio at reduced power output to improve engine efficiency at such reduced power output.

The use of cams for controlling the position of the piston is particularly advantageous in that it allows the piston to remain essentially stationary in the approximate top dead center position during admission of the compressed air charge and also allows the piston to remain stationary during at least initial combustion of the air fuel mixture. Even in conventional crank shaft engines combustion of the charge starts approximately 15 degrees before top dead center in order that the combustion process is sufficiently complete when the piston has passed the top dead center and is entering the power stroke thereof. In conventional four stroke engines the admission of the charge does not present a problem as approximately 50% of the movement of the piston is devoted to the admission and compression of the gas charge. However in the present process where the compression step has been separated, one requires a substantial amount of time to allow admission of the compressed air and fuel with the piston adjacent the top dead center position. For this reason, piston and crank arrangements are less effecient as they comprise the extent of positive exhaust to allow sufficient time for charge admission and combustion to be completed prior to the power stroke. These problems are fully solved by use of cams where the flexibility in controlling the piston movement is greatly enhanced. In this way, the piston can be maintained in the top dead center position or the approximate top dead center position as needed. Generally up to about 30 degrees of a 360 degree cycle of the piston or one full revolution of a single profile radial cam has proven satisfactory. It has been found, charge admission and sufficient combustion can be completed in about 25 to 30 degrees, although this can vary in different applications and engine speeds and is cited as a general guide. Therefore with this design, one is able to achieve positive exhaust of the combusted air and fuel completed more rapidly due to the cam profile and provide sufficient time for charge admission and charge combustion prior to the power expansion stroke. Thus, some of the time formerly used for positive exhaust is now advantageously used for charge admission and combustion while still providing positive exhaust.

The combustion chamber volume is variable and controlled by the engine output control 51 and allows the power output of the engine to vary. Because of the substantially larger volume of the storage chamber 4 relative to the combustion chambers, the pressure within a given combustion chamber remains essentially constant regardless of the volume determined by the variable adjuster. Therefore, the engine works under essentially constant charge pressure over substantially the power output of the engine. Under maximum power, determined by the engine output control 51, including Fuel control 53, the compressor may not be capable of completely satisfying the above requirement and the pressure could drop slightly under maximum output. The compressor is sized to provide the desired pressure at the design power output of the engine which is normally about 70% or 80% of the maximum horse power and at outputs above that the amount of fuel admitted is increased to provide additional power. This problem is partially overcome by the compressor operating through the storage chamber which obviously can provide a certain amount of initial extra pressure at maximum power output, however continued running of the engine at maximum power will result in a slight drop in the desired pressure. This disadvantage is outweighed by the increased efficiency possible by sizing the compressor in this manner. If the engine is designed to operate at maximum power most of the time, the size of the compressor can be selected to meet these requirements, however, it will be at the expense of efficiency of the engine at reduced power and is generally not preferred for automobile applications. The compressor preferrably services a number of cylinders and is sized to provide a pressure sufficient to allow deep expansion to about atmospheric pressure when the engine is running at about the design power output determined by the required combustion chamber volume.

FIGS. 1 and 2 also illustrate the use of a piston control arm 34 in FIG. 1 and 42 in FIG. 1*a* which are spring biased to maintain the cam engaging roller 30 in contact with the cams. This simplifies the necessary shape of the cam although it is not essential to the present invention. For example, it is possible to use other arrangements for maintaining the position and association of the piston with the cam shaft such as dual profile cams which effectively can push and pull the piston in combination with a rigid extension from the piston, as but one example.

Figure 3:
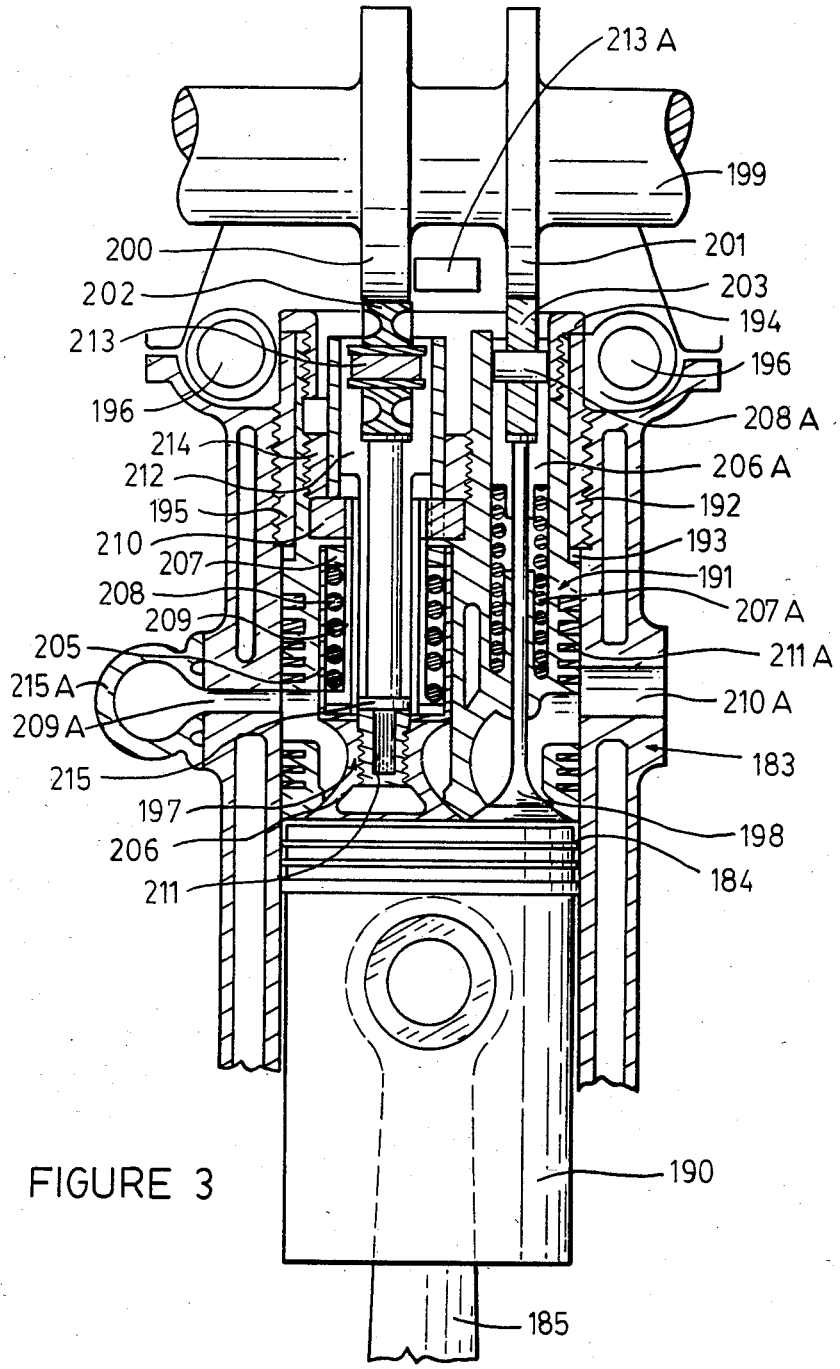
FIG. 3 is a section through a modified power generator illustrating a different cylinder head configuration.
Figure 6:
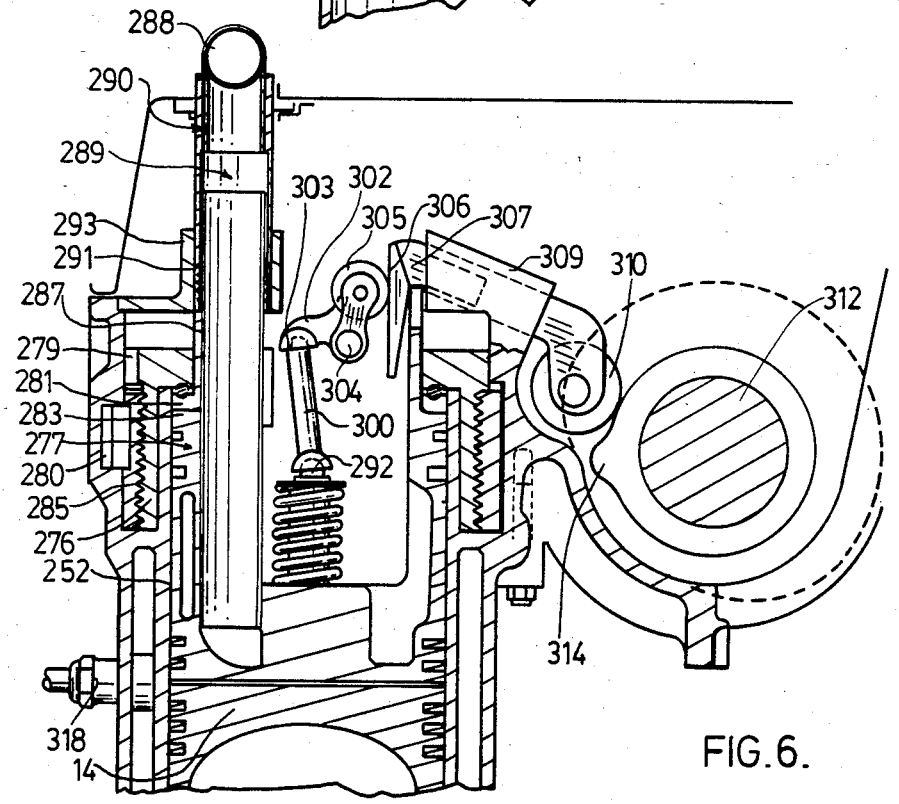
FIG. 6 is a section through a further modified cylinder head.

FIG. 2 shows a slightly different embodiment which uses a single lobed radial cam 32*a* mounted for rotation about shaft 60. Additional details of the cylinder sleeve 16 is shown as well as further details of the inlet valve 10 and the exhaust valve 24. The means for controlling the position of the cylinder sleeve 16 is generally indicated as 50 and details thereof are shown in FIG. 3. Again a spring loaded arm 34 is shown for biasing the piston 14 into engagement with the radial single lobed cam 32*a*. Some problems do occur as a result of the movement of the cylinder sleeve 16 and the inlet valve 10 preferrably has an associated snorkel tube to provide a simple arrangement for accomodating movement of the cylinder sleeve and inlet valve. The snorkel tube is telescopic to provide this flexibility of cylinder head movement (details of which are shown in FIG. 6). The problems are not as great with the exhaust valve 24 as an enlarged exhaust port 90 can be provided with the exhaust valve 24 dumping into the exhaust port regardless of the position thereof. Other arrangements are possible for providing the variable combustion chamber volume and particularly a moveable cylinder head could be provided which moves within a fixed cylinder and includes sealing means therewith. Such an arrangement is shown in FIG. 3.

As shown in FIG. 1, the power output of the engine is controlled by output control 51 such as a normal accelerator linkage. The output control 51 is in communication with fuel injector 53 and in combination with the size of the combustion chamber and the pressure of the air charge determines the engine output. In some cases it may be preferrable to use an air mass flow senser 9, shown in FIG. 1, to directly control the amount of fuel to be introduced. When this is down the engine output control 51 merely controls the combustion chamber volume which will effect the amount of air flow thereby resulting in the desired amount of fuel.

In FIG. 3 there is shown a transverse cross section of a cylinder block 183, having one or more cylinders 184, in line. Deep skirted piston 190 is connected with a conventional connecting rod 185 for connection to a cam shaft. The charging cycle commences at about the time piston 190 reaches top dead center. This gives the admission valve 197 time to open, and with an opening intake valve a slight additional upward movement of piston 190 will not "compress" the incoming charge significantly or dangerously for three reasons:

a. only a small amount of charge will have entered the "combustion" chamber in the cylinder 184 during any additional upward movement of piston 190, as such charge will still be at a slightly reduced pressure,
b. the total "back-up" volume of the charging port, intake port, charge transmission ducting etc is great relative to the volume of the charging chamber, and
c. the charge can be slightly cooled on its way from the precompressor, yet the pressure sensor has maintained the pressure. To quote some typical figures, with the pressure sensor set at 150 psig, the temperature of the charge would be approximately 1200 degrees Rankin. This temperature would cool in transit, or may be cooled purposely, resulting in a denser 150 psig charge, possibly at 1100 degrees Rankin; this would be below the safe temperature of 1200 degrees Rankin; with cooling the pressure may be raised.

In connection with the above, it may be appropriate at this time to discuss the results of heat loss by the charge on its way from the pre-compressor to the combustion chamber. This loss of heat may readily be prevented by insulating the transfer ducting, but cooling the pre-compressed charge, without loss in pressure may improve the efficiency of the engine. The denser charge, or in other words, the required amount of fuel plus the required amount of oxygen, for a certain power output, would be "packed" in a smaller volume "charging" chamber. Thus the ratio between the initial volume upon ignition, and the final volume, after expansion, of the combustion chamber would be greater for a cooled charge; in other words, the expansion ratio would be greater and this could mean a greater amount of energy extracted from the same weight of charge. The gain in energy may more than offset the loss in energy caused by cooling the pre-compressed gas charge.

To return to FIG. 3, the cylinder block 183 is headless and has the cylinder bore 184 well extended beyond the top dead center position of piston 190. The top portion of the cylinder bore contains a cylindrical valve carrier 191, which is reciprocably disposed within limits. The uppermost portion of the cylinder bore is provided with an internal thread and carries a hollow cylindrical jackscrew 192. Jackscrew 192 engages valve carrier 191 on a ledge formed around the upper portion of valve carrier 191, with a hardened steel wear ring 193 ensuring longevity. Jackscrew 192 is locked to valve carrier 191 by retaining ring 194, in a rotatable manner. Jackscrew 192 is provided with an integral worm gear 195 which is engaged by two worms 196, which are connected with a shaft to a rotary power actuator, not shown. Rotation of worms 196, thus will raise or lower valve carrier 191 as required, with the raising or lowering constituting a geometric variation of the expansion ratio, and a variation in power output by virtue of varying the charge admission volume at essentially constant pressure determined by the pressure in the storage chamber. Since no compression takes place in the power cylinders of this engine, the "normal" compression ratio will be referred to as expansion ratio in this disclosure. Besides, it is really the expansion ratio which determines thermal efficiency.

Valve carrier 191 contains two valves, a charge and spring biased admission valve 197 and an exhaust valve 198. These valves are shown with mechanical valve lash adjustment, shims in the case of 197 and threads in the case of 198. The overhead camshaft 199 is provided with extra large diameter minor diameter lobes to actuate the valves 197, 198 directly via rollers, admission valve roller 202, exhaust valve roller 203. The admission valve lobe is 200, the exhaust valve lobe is 201. Since the overhead camshaft 199 is rotatably supported by the cylinder block 183, the relationship between the top position of the piston 190 and the bottom position of the valves, 197, 198 is fixed and no interference will occur at any setting of valve carrier 191. At a "minimum volume" setting, idling, the lift of valves 197, 198 will be minimal, with admission valve 197 just lifting enough to admit sufficient charge for idling. The ignition would be advanced accordingly. The exhaust valve 198 would have an extra high lift with a rapid closing so that even at idling setting, the exhaust would be expelled readily. Therefore, the timing of the inlet and exhaust valves vary with and is automatically determined by the volume of the combustion chamber.

It should be noted that, for illustrative purposes only, overhead camshaft 199 and valve carrier 191 have been rotated ninety degrees from their actual position. In actuality, overhead camshaft 199 would be parallel with the axis of crankshaft 186. Overhead camshaft 199 is driven at engine speed by conventional means, preferrably a timing belt, a silent chain or a roller chain.

Admission valve 197 is charge biased in the closed position, with a greatly increased closing bias after opening. This aids rapid closing. Components making up admission valve 197 are: guide sleeve 205, lower head 206, spring retaining collar 207, bias spring 208, spring support tube 209, cam follower guide 210, head retainer 211, cam follower 212, intake valve roller 202 and roller pin 213. Spring support tube 209 threads into a collar on cam follower guide 210, which is retained in valve carrier 191 by admission valve retaining ring 214. Adjustment shims 215 complete the admission valve assembly. Rotation about the long axis of the admission valve 197, is prevented by the bifurcated top end of cam follower guide 210. Exhaust valve 198, is carried directly in valve carrier 191 and comprises a poppet type exhaust valve 198, with a threaded end portion, which engages a bifurcated exhaust cam follower 206A. Exhaust valve spring 207A biases the valve in the closed position and is extra long to accommodate a high lifting action. A bifurcated guide bore is provided directly in the casting for valve carrier 191 and this keeps exhaust valve roller 203 perfectly aligned. Exhaust valve roller pin 208A completes the assembly. Adjustment is carried out by lifting valve carrier 191 into high position and by engaging the stem of the exhaust valve with a special tool to rotate the valve through the exhaust ports. Removal of the exhaust manifold would be required.

A charge admission port 209A and a static exhaust port 210A are provided in the top portion of cylinder block 183. Valve carrier 191 is provided with an admission port and an exhaust port closed by their respective valves. Sealing rings 211A, vertical separator seals and oil seals complete the sealing arrangement for valve carrier 191. Rotation of valve carrier 191 is prevented by locator pins engaging locator pin guide 213A which is bolted to the cylinder block 183.

A cam driven positive displacement charge pre-compressor of the piston variety with self actuating inlet valves and outlet valves, is preferrably used. The charge pre-compressor compresses the charge, or air, to pre-determined values, depending on fuel characteristics, and depending on whether, after cooling is selected; the main considerations being the ignition temperature of the fuel to be used, the point of admission of fuel, and the relationship between energy lost by after cooling and energy gained by a denser charge and a resulting greater expansion ratio. A pressure sensor in the transmission duct 215A would direct the unloading of the charge pre-compressor by means of an unloading device acting on the self actuating inlet valve of the pre-compressor; with the timing of the unloading action taking place at the bottom of the stroke of the pre-compressor. Thus at idling, the compressor intake valve would be unloading during most of the bottom portion of the stroke, with the effective compressing stroke increasing as the engine power output increases. All components cited for the pre-compression of the charge are standard commercially available ports for compressors.

Figure 4:
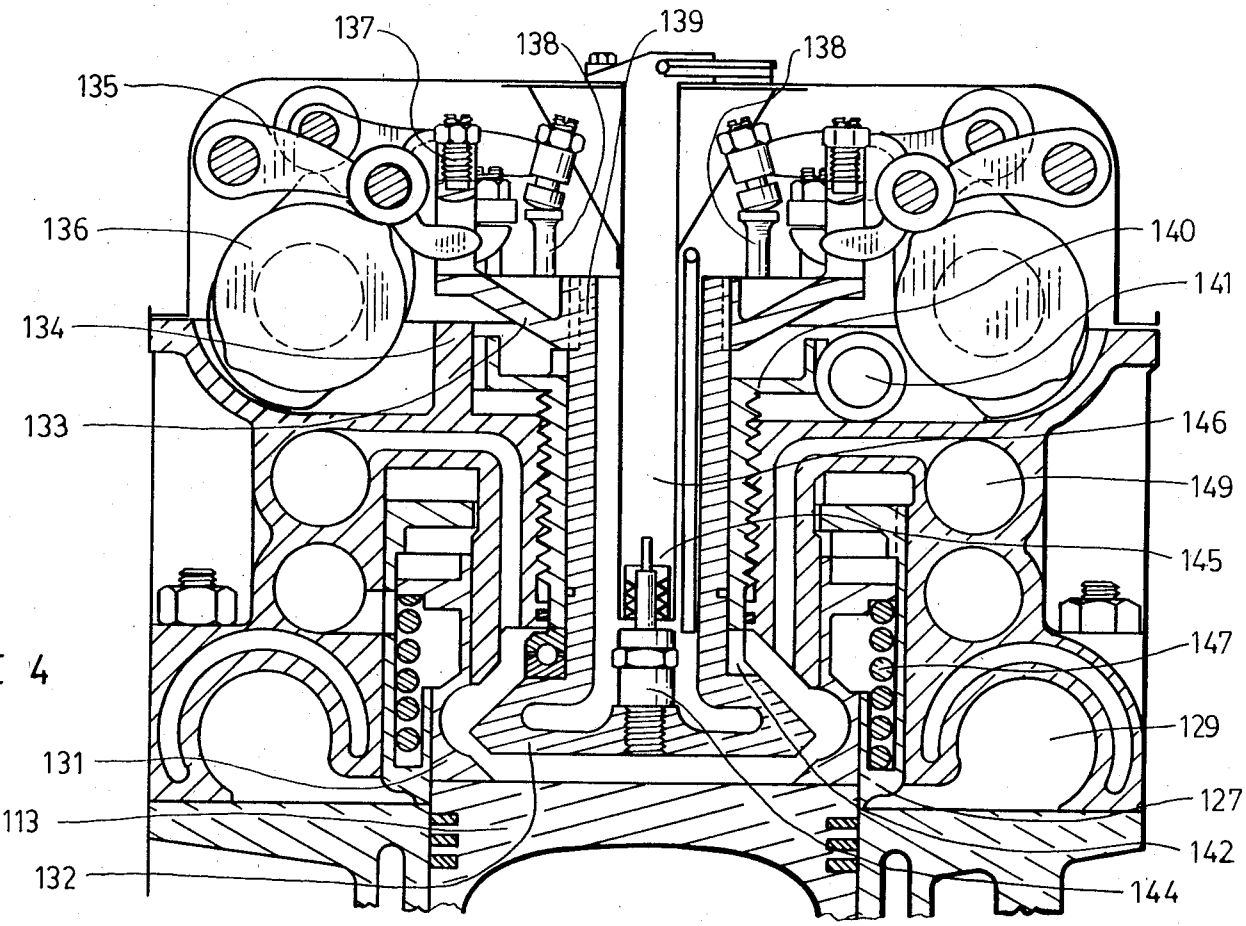
FIG. 4 is a section through a further modified cylinder head which is charged biased.

During the upstroke of the power piston 113 shown in FIG. 4, the admission sleeve valve 131 is lowered to a position, which just clears the top position of the power piston 113. Telescoping head 132 is strongly biased downwardly by the high pressure of the pre-compressed charge due to area differential, and carries admission sleeve valve with it until stopper disc 133 bottoms out on travel limiter 134. Stopper disc 133 is threaded onto the hollow stem of telescoping head 132 and may be precision adjusted to stop the travel of telescoping head 132 to clear the top position of the power piston 113 by a close margin. There are two reasons for this action. The admission valve takes advantage of the upward exhaust stroke to be ready and in position for the high pressure charging cycle. The down position of the complete combustion chamber roof formed by admission sleeve valve 131 and telescoping head 132, makes exhaust expulsion total and positive to exhaust port 129, especially with the full circumference of the top edge of the power cylinder open. After the power piston 113 has reached the top position of its travel, exhaust sleeve valve 127 closes fully biased by spring 147; exhaust sleeve valve 127 started closing well ahead of the power piston reaching its top position. The thin layer of exhaust gas squished above the top of power piston 113 during the last few degrees of piston travels serves to cushion the piston travel to some extent. Bias breaker arms 135 are now actuated by a quick acting lobe on the valve cam 136 and make contact with bias breaker towers 137, which are integral ports of stopper disc 133. The result is that telescoping head 132, is lifted slightly off admission sleeve valve 131, which is held down rigidly by intake push rods 138. The high pressure charge will rush in below telescoping head 132 and will not bias same in the reverse upward direction, again due to vast area differential between the lower surface of telescoping head 132 and the surface thereof defined adjacent passage 150 which in combination with passage 151 allows distribution of the high pressure charge from inlet port or donut 149. The telescoping head includes spark plug 144 as well as a cored out area for circulating cooling fluid.

The amount of upward travel of telescoping head 132 by gas pressure is predetermined by the position of jack screw 139, which position controls the power output of the engine. Jackscrew 139 comprises a hollow cylinder, externally threaded to match a mating thread in the cylinder head casting, and is provided with a worm gear, jackscrew drive gear 140 at the top. Jackscrew drive gear 140 is engaged by worm shaft 141 which is power actuated in a linear relationship with the throttle pedal position in the vehicle; if the engine is used in a vehicle. The position of jackscrew 139 therefore, determines the volume of the combustion chamber, and which volume in turn determines the quantity for the weight of the charge admitted, with the charge being at a constant maximum permissible pressure, and, as stated, the weight of the charge for each charging cycle determines the energy of the power stroke.

Telescoping head 132 is provided with hardened steel impact ring 142, which may be replaced by an anti-friction bearing. The threads on jackscrew 139, are well lubricated by engine oil and include seals to prevent loss of high pressure charge.

The power camshaft is executed to retain power piston 113, in the top position over about 28 degrees and by the end of this retention, intake sleeve valve 131 is closed by valve camshaft 136. A powerful charge bias, due to area differential aids in lifting admission sleeve valves quickly to the closed position. At this instance, spark plug 144 ignites the charge. Spark plug 144 is electrically connected through a sliding sealed joint 145, within an insulated rod 146, with the ignition coil, not shown. Exhaust sleeve valve 127, and admission sleeve valve 131 are biased in opposite directions by a commonly shared, large concentric coil spring, mutual valve spring 147. The travel and positions of exhaust sleeve valve 127 has fixed limits. The travel and positions of admission sleeve valve 131 do not have a fixed top position—the bottom position has a fixed limit. Therefore, the lash between the valve cam 136 and admission push rods 138, can be fairly large, but, as stated before, this causes no problem since admission sleeve valve 131 is carried downward by downward bias of telescoping head 132 as soon as the downward bias overcomes the upward bias of the combustion gas charge, near the final portion of the power stroke, and the admission lobe on valve camshaft 136 is executed to take up this lash gently and has plenty of time to do so, namely, the complete exhaust stroke. Therefore, the telescoping head moves to provide positive exhaust and then moves away from the piston 113 to define the combustion chamber, the volume of which is controlled by the jackscrew.

Exhaust sleeve valve 127 is lifted by exhaust pull rods not shown. "Tappet" clearance is adjusted by conventional threaded means. Since power pistons 113 carry out two power strokes per revolution, the valve cams must be provided with two lobes per engine revolution for each function, the functions being bias breaker, admission sleeve valve depression, exhaust sleeve valve lifting. Since quick action is required over few degrees of rotation for the novel three cycle action, the valve camshaft minor diameter is substantial and roller equipped rockers aid in this respect as shown.

Adjustment of the cylinder head has been described with respect to a jackscrew arrangement which is an example of a high mechanical advantage device with good accuracy and repeatability. Other devices which are suitable for effecting adjustment of the cylinder head location include a helical ramp type device and a linear wedge type device. Fluid actuation is also possible.

Figure 5:
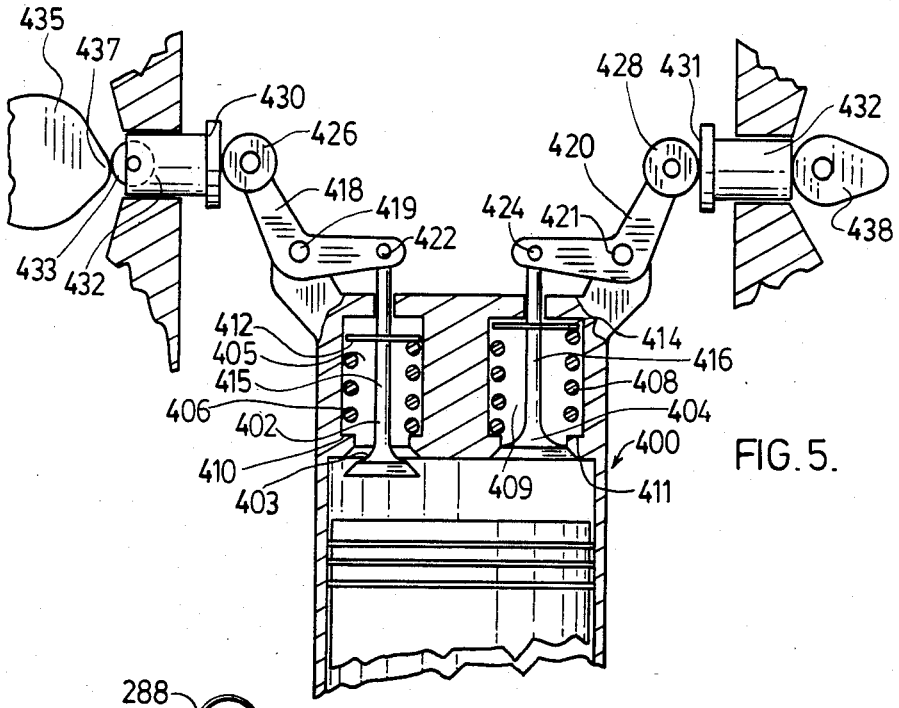
FIG. 5 is a section through a further modified cylinder head which uses poppet type valves actuated in a simple manner.

A simplified movable cylinder head 400 is shown in FIG. 5 which would be controlled either by the charge biasing action previously described where during the exhaust stroke the cylinder head moves toward the piston 450 due to the pressure of the charge acting on the closed intake valve 402 and upon opening of the intake valve the cylinder head will reverse direction due to the surface area differential within the cylinder head relative to the inlet valve in combination with the limiting of the end positions of the cylinder head. The cylinder head 400 may be precisely controlled by a jackscrew of wedge type drive such as shown in FIG. 3. In this way, the cylinder head moves to provide additional positive exhaust and returns to a position partially defining the combustion chamber volume during admission of the charge.

Both the intake valve 402 and the exhaust valve 404 are of the poppet type valve spring biased to the closed position by springs 406 and 408 respectively which are seated against surface 410 and 411 of the cylinder head and keeper 412 and 414 on intake valve stem 415 and exhaust valve stem 416 respectively. The movable cylinder head 400 includes 'L' shaped rocker arms 418 and 420 pivotally secured to the cylinder head at 419 and 421 and secured at 422 and 424 for driving intake stem 414 and exhaust stem 416 respectively. The opposite arm of the rockers 418 and 420 include cam rollers 426 and 428 in contact with an enlarged face 430 and 431 of slide actuators supported in the stationary cylinder block. Slide actuator 432 for the intake valve includes roller 433 in contact with side mounted cam 435. Cam 435 includes a large diameter control surface which maintains the intake valve 402 in the closed position and a fast actuating surface 437. To avoid wear, the camshaft follower is roller 433. The enlarged surface area 430 allows movement of the cylinder head relative to the camshaft 435 without introducing substantial lash problems as this cylinder head movement does not appreciably affect the valve actuation mechanism. A similar arrangement is used with respect to the exhaust valve, however, as rapid opening and closing is not required, the cam 438 is of a smoother profile and is in direct contact with the rear face of slide actuator 432. The pressurized charge is in constant communication with rear face 403 of the intake valve 402 and provides a bias pressure on the cylinder head 400. The intake torus 405 is in constant communication with a snorkel tube which accommodates the movement of the cylinder head 400. Exhaust torus 409 communicates with an oversize exhaust duct (not shown) in the stationary cylinder block which provides a simple method of controlling the exhaust gases.

A modified cylinder head is shown in FIG. 6 and provides additional details with respect to the screw thread adjustment used to determine the top position of the cylinder head 250 during charging of the combustion chamber. Cylinder head 250 reciprocates in the length of cylinder walls 252 between an adjustable end position and a position of reduced combustion chamber valve. At the upper end 277 of the movable cylinder head 250, a ball bearing raceway 278 has been provided in contact with an externally threaded rotating power determinator sleeve 276 and includes an external ring gear drive 279 for determining the adjustable position of the cylinder head and hence the volume of the combustion chamber defined between movable cylinder head 250 and the piston 14. Determinator sleeve 276 is threadingly engaged with the static internally threaded ring 285 retained in the stationary portion of the engine block by an over sized precision ground snap ring type retaining ring 286. Rotation of gear 279 causes the power actuator 276 to move relative to the threaded ring 285 and vary the upper position of the movable cylinder head 250 and hence the final volume of the combustion chamber defined between cylinder head 250 and piston 14. It should be noted that power determinator 276 does not fully control the position of the movable cylinder head 250, but merely determines the adjustable end positon defined by stop face 281 of raceway 278 and opposing stop face 283 of movable cylinder head 250. This adjustable end position is used to control the volume of the combustion chamber and as a large supply of precompressed charge is available the power output of the engine varies with the combustion chamber volume. There is no need, according to the structure disclosed to throttle the admission of the air charge as generally employed in the prior art which is an inefficient method of controlling the power output of the engine.

Cylinder head 250 is axially movable within the cylinder walls 252 and the admission charge pressure provided within the manifold 288 and the snorkel tube assembly 289. Snorkel tube assembly 289 includes a tube 287 fixed in the movable cylinder head 250 and telescopically received within tube 290 fixed relative to the upstream charge admission components. A stationary guide 293 sealingly engages the exterior of tube 290 and is of a length to be in contact with a number of sealing member 291 carried on the exterior of tube 287. This arrangement allows axial movement of tube 287 with tube 290 and maintains a pressure seal therewith at all positions of the movable cylinder head 250.

The pressure of the charge creates a bias force urging movable cylinder head 250 downwardly when the intake valve is close and the exhaust valve is open during the movement of piston 14 in an exhaust stroke towards the movable cylinder head 250. The movement of cylinder head 250 towards piston 14 improves the positive exhaust of the combusted fuel and increases the engine efficiency. Movement of cylinder head 250 towards piston 14 is initially slowed and subsequently reversed by opening of the intake valve admitting the pressurized charge into the combustion chamber. The pressure of the charge acting on the combustion side of the cylinder head 250 causes the cylinder head 250 to move towards raceway 278 and seat stop faces 281 and 283. The cylinder head has therefore moved to the desired adjustable position defining a particular combustion chamber volume determined by power actuator 276. Therefore, in this embodiment an adjustable end position is provided which determines the combustion chamber volume and the power output of the engine. The movable head is freely slidable and movement of the cylinder head to provide additional exhaust of the combusted fuel is limited and determined by the admission of the pressurized charge.

Charge admission valve stem 292 is controlled by connecting member 300 having a ball joint connection with valve stem 292 and a ball joint connection with a generally pivoted L-shaped rocker arm 302 at position 303. Rocker arm 302 is rotatable about shaft 304 which moves with the movable cylinder head 250. At one end of the L-shaped arm 302, cam engaging roller 305 is in contact with the planar face 306 of actuator 307. This actuator is slidably received with the guide 309 and at the opposite end includes a cam engaging roller 310 in contact with actuator surface 314 of cam shaft 312. As the actuator surface 314 strikes roller 310, it forces member 307 to slide within the guide 309 and cause rotation of the L-shaped arm 302 about the shaft 304 causing the valve to open and allow charge admission into the combustion chamber. Because of the long planar face 306, movement of the cylinder head 250 in the vertical direction of FIG. 6 does not appreciably affect the timed operation of the valve and provides a simple arrangement whereby the valve can move with the moveable cylinder head and the actuation of the valve namely members 310, 312, 314, 307 and 309 are supported in the stationary portion of the engine adjacent the movable cylinder head. A similar arrangement can be provided for the exhaust valve (not shown) which is included in the movable cylinder head.

The arrangement of FIG. 6 including the screw thread of the power actuator 276 and the control of the valves and the use of the snorkel tube can advantageously be in the combination with the movable cylinder head and cylinder shown in FIG. 5. The use of roller 310 in combination with the actuation surface 314 provides for accurate, fast opening and closing of the charge admission valve. The spark plug 318 is shown secured in the cylinder wall 252. It is also possible for the spark plug 318 to be secured in the movable cylinder 250. It is preferred that this engine use an approximate stoichiometric fuel air mixture to enhance power output. Higher air mass serves to generally waste energy.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A variable power internal combustion engine comprising a separate air compressor for receiving and compressing a flow of air to a given pressure, said compressor having an inlet valve introducing a flow of air into said compressor and an outlet valve for exhausting compressed air out of said compressor into a compressed air storage means, at least one expander having a cylinder, a cylinder head closing an end of said cylinder, a piston reciprocally mounted in said cylinder for movement away from said cylinder head in a power stroke from an initial position defining a combustion chamber within said cylinder between said cylinder head and said piston, to a deep expansion position and for movement in an exhaust stroke towards said cylinder head returning to said position defining said combustion chamber; an inlet valve for said combustion chamber connecting said compressed air storage means and said combustion chamber for directing a flow of compressed air into said combustion chamber during an intake phase intermediate the start of said power stroke and the completion of said exhaust stroke, an exhaust valve of exhausting an expanded flow of air from said cylinder during said exhaust stroke, and means for adjusting the volume of said combustion chamber;

said compressed air storage means receiving said pressurized flow of air from said compressor and being of a volume adequate to provide compressed air in said combustion chamber essentially at said given pressure essentially over the power output of said engine, means for introducing an amount of combustible fuel in said compressed charge to be present with compressed air in said combustion chamber and providing combustion of said an amount of fuel in said cylinder with said inlet and exhaust valves closed, cam shaft means in contact with said piston for absorbing and storing the energy of said power stroke of said piston and controlling movement of the piston within said cylinder during said exhaust stroke and said intake phase to move said piston towards said cylinder head and maintain said piston in said position defining the combustion chamber volume for a time sufficient to complete the flow of compressed air into said cylinder and provide a compressed air pressure within said combustion chamber before combustion essentially equal to the pressure of said storage means and to allow substantial combustion of said compressed air and amount of fuel prior to commencement of said power stroke, said means for varying the volume of said combustion chamber being controlled in accordance with power requirements to provide variable power output and improved efficiency of said engine at power outputs reduced relative to a given design power output of said engine by providing a variable expansion ratio of a minimum of at least about 30 to 1 at said given design power output and higher with reduced power output.

2. A variable power internal combustion engine as claimed in claim 1 including means for cooling said flow of compressed air for admission to said combustion chamber.

3. A variable power internal combustion engine as claimed in claim 1, said cam shaft means being an axial cam shaft and said piston including an arm pivotally secured in said engine and pivotally secured to said piston adjacent said cam shaft for maintaining the location of said piston in the axial length of said cam shaft, and spring means associated with said arm to bias said piston into continuous contact with said cam shaft.

4. A variable power output engine as claimed in claim 1 said means for adjusting the volume of said combustion chamber being of a type having high mechanical advantage to maintain said cylinder head during combustion of said air and fuel.

5. A variable output engine as claimed in claim 1 wherein said given pressure is at least about 500 psig and said fuel is injected into said combustion chamber after said inlet valve has closed, the injection of fuel resulting in the start of the combustion process.

6. A variable power internal combustion engine as claimed in claim 1, said cam shaft means being a radial cam shaft and said piston being biased into contact with said cam.

7. A variable power internal combustion engine as claimed in claim 6 said piston including a coil torsion spring externally secured within said engine with an end of said spring urging said piston into contact with said radial cam.

8. A variable output engine as claimed in claim 1 wherein said given pressure is selected to achieve a compressed air pressure in said combustion chamber before combustion in the range of 150 to 400 psig which requires ignition of the fuel and compressed air in said combustion chamber.

9. A variable output engine as claimed in claim 8 wherein said fuel is mixed with said compressed air prior to introduction to said combustion chamber and reduces the temperature of said compressed air due to at least partial vapourization of said fuel.

10. A variable output engine as claimed in claim 1 wherein said cylinder and said cylinder head move as a unit for adjusting the volume of said combustion chamber volume, said cylinder head including said inlet valve for said combustion chamber and said exhaust valve.

11. A variable output engine as claimed in claim 10 wherein said cylinder head is biased by said compressed air of said storage means to move towards said piston during said exhaust stroke to provide further positive expulsion of said exhaust and move in the opposite direction during admission of said flow of compressed air into said combustion chamber and stop at a position determined by said adjusting means thereby defining the volume of said combustion chamber prior to combustion of said air and fuel.

12. A variable output engine as claimed in claim 10 wherein said inlet valve and said exhaust valve are mechanically operated by members fixed in a stationary portion of said engine, the timing of said inlet and outlet valves varying with and being determined by the volume of said combustion chamber.

13. A variable output engine as claimed in claim 1 wherein said cam shaft means is shaped to maintain said piston generally stationary in said position defining said combustion chamber for at least about 15 degrees of a 360 degree rotation of a single lobed cam shaft means.

14. A variable output engine as claimed in claim 13 wherein said cam shaft means maintains said piston defining said combustion chamber for about 30 degrees of rotation of said cam shaft means which is single lobed.

15. A variable output engine as claimed in claim 14 wherein the ignition of the fuel and compressed air is at least about 15 degrees of rotation of said cam shaft means before movement of said piston in said power stroke.

16. A variable output engine as claimed in claim 14 wherein the flow of compressed air into said combustion chamber occurs for about 15 degrees rotation of said cam shaft means.

17. A variable power internal combustion engine as claimed in claim 1 including pressure sensor means associated with said storage means for controlling the output of said compressor to reduce the work thereof when the compressed air in said storage means is essentially at said given pressure.

18. A variable power internal combustion engine as claimed in claim 17 wherein said compressor being sized relative to said at least one expander to provide expansion of said compressed air during said power stroke to about atmospheric pressure.

19. A variable output engine as claimed in claim 17, said means for adjusting the volume of said combustion chamber having a high load capacity and selected from the group consisting of a screw thread, a helical ramp and a linear wedge to thereby assure accurate positioning of said cylinder head for a given input to said means for adjusting the volume of said combustion chamber volume.

20. A variable output engine as claimed in claim 17 said compressor being a piston compressor operatively connected to said cam shaft means.

21. A variable output engine as claimed in claim 20 said compressor output being controlled by maintaining the inlet valve open during a compression stroke of said compressor when said compressed air in said storage means is at said given pressure and the outlet valve of said compressor only opens when the air pressure in the compressor is above said given pressure.

22. A variable output engine as claimed in claim 20 wherein the piston of said compressor can be adjusted to provide a variable stroke and controlling the stroke of said piston in accordance with the pressure sensed in said storage means.

23. A cyclic process for an internal combustion piston engine with variable power output comprising the steps of compressing a flow of air to a given pressure to provide a compressed air charge supply, accumulating a storage of compressed air charge supply and including an inlet valve separating said flow of air being compressed from the air charge supply, operatively connecting the accumulated storage of compressed air with an inlet valve of a power expander having a combustion chamber and a movable piston which defines part of said combustion chamber when said piston is essentially stationary and defining said combustion chamber volume, holding said piston essentially stationary defining said combustion chamber for at least about 15 degrees of a 360 degree piston cycle, closing said inlet valve of said power expander after admission of an amount of compressed air determined by the volume of said combustion chamber, admitting a combustible fuel to mix with said amount of compressed air to be at least present in said combustion chamber, igniting and effecting substantial combustion of the compressed air and fuel in said combustion chamber prior to said piston moving in a power stroke against a cam shaft, opening an exhaust valve in a manner to allow positive expulsion of the combusted fuel and air by movement of said piston in a direction opposite to the direction of said power stroke caused by further rotation of said cam and closing such exhaust valve after positive expulsion of the combusted fuel and air, monitoring the pressure in said storage of compressed air and varying such flow of air to be compressed to reduce energy expended in compressing such flow of air when the desired pressure of compressed air is achieved, and adjusting the volume of such combustion chamber in accordance with power output requirements of such engine, said process providing a variable expansion ratio of at least about 30 to 1 at a design power output of such engine and a higher expansion ratio at reduced power output to improve engine efficiency at such reduced power output.

24. A cyclic process as claimed in claim 23 including adjusting the volume of what was such combustion chamber during positive expulsion of the combusted fuel in a manner to provide additional positive expulsion of the combusted charge.

25. A cyclic process as claimed in claim 23 including automatically adjusting the timing of the admitting of the combustible fuel with changes in the volume of such combustion chamber.

* * * * *